US007703231B2

(12) United States Patent
Wei

(10) Patent No.: US 7,703,231 B2
(45) Date of Patent: Apr. 27, 2010

(54) GUN ATTACHMENT HOLDER

(76) Inventor: Wilson Wei, P. O. Box 24-108, Taipei (TW)

( * ) Notice: Subject to any disclaimer, the term of this patent is extended or adjusted under 35 U.S.C. 154(b) by 296 days.

(21) Appl. No.: 11/604,149

(22) Filed: Nov. 27, 2006

(65) Prior Publication Data

US 2008/0120891 A1 May 29, 2008

(51) Int. Cl.
*F41A 15/00* (2006.01)

(52) U.S. Cl. ..... 42/90; 42/124; 42/125; 42/126; 42/127; 42/128; 42/85; 42/148; 42/73

(58) Field of Classification Search ..... None
See application file for complete search history.

(56) References Cited

U.S. PATENT DOCUMENTS 4,766,800 A * 8/1988 Miller et al. ..... 89/33.02
7,188,978 B2 * 3/2007 Sharrah et al. ..... 362/396
7,260,912 B2 * 8/2007 Liu ..... 42/127
2008/0040965 A1 * 2/2008 Solinsky et al. ..... 42/90

* cited by examiner

*Primary Examiner*—Troy Chambers
*Assistant Examiner*—Samir Abdosh
(74) *Attorney, Agent, or Firm*—Jackson IPG PLLC

(57) ABSTRACT

A gun attachment holder includes a device holder, which has a coupling groove detachably coupled to a coupling flange of a gun and a sliding groove transversely extending across the coupling groove, two locking members reversely arranged in parallel and slidably mounted in the sliding groove and movable between a locking position to lock the device holder to the coupling flange of the gun and an unlocking position to unlock the device holder from the coupling flange of the gun, and a torsional spring set in between the locking members to hold the locking members in the unlocking position.

4 Claims, 4 Drawing Sheets

GUN ATTACHMENT HOLDER

BACKGROUND OF THE INVENTION

1. Field of the Invention

The present invention relates a gun attachment and more particularly, to a quickly detachable gun attachment holder that can easily and quickly detachably attached to a gun to hold an illuminator, infrared pointer, or laser pointer.

2. Description of the Related Art

A gun is a weapon used in martial arts. Nowadays, various kinds of guns are used for exercises and competitions. Further, a gun may be attached with an attachment, for example, an illuminator, infrared pointer, or laser pointer. Various gun attachment holders have been disclosed for fastening to a gun to hold a gun attachment. A conventional gun attachment holder is known having a coupling structure for coupling to a gun, and a locking lever turnable between the locking position to lock the gun attachment holder to the gun after the coupling structure has been coupled to the gun and the unlocking for allowing removal of the gun attachment holder from the gun. However, this design of gun attachment holder is not a human-factors engineering design. It is complicated to install the gun attachment holder.

SUMMARY OF THE INVENTION

The present invention has been accomplished under the circumstances in view. It is the main object of the present invention to provide a quickly detachable gun attachment holder that can conveniently and quickly detachably fastened to the gun to hold an illuminator, infrared pointer, or laser pointer.

According to one aspect of the present invention, the quickly detachable gun attachment holder comprises a device holder adapted to hold a gun attachment, the device holder having a coupling groove longitudinally disposed at the top side, two through holes aligned at two opposite lateral sides of the coupling groove, and a transverse sliding groove extending cross the coupling groove in communication between the two through holes, two locking members slidably and reversely arranged in parallel in the through holes and coupling groove of the device holder and adapted to secure the device holder to a gun, the locking member each having a knob at one end, a stop block at the other end, and an engagement block protruded from an inner side of the stop block, the knob of one locking member being stopped at the outer side of the stop block of the other locking member, and a torsional spring set in between the two locking members, the torsional spring having two opposite ends respectively stopped against the two locking members.

Further, the stop block can be a conical block or beveled block.

DETAILED DESCRIPTION OF THE INVENTION

Figure 1:
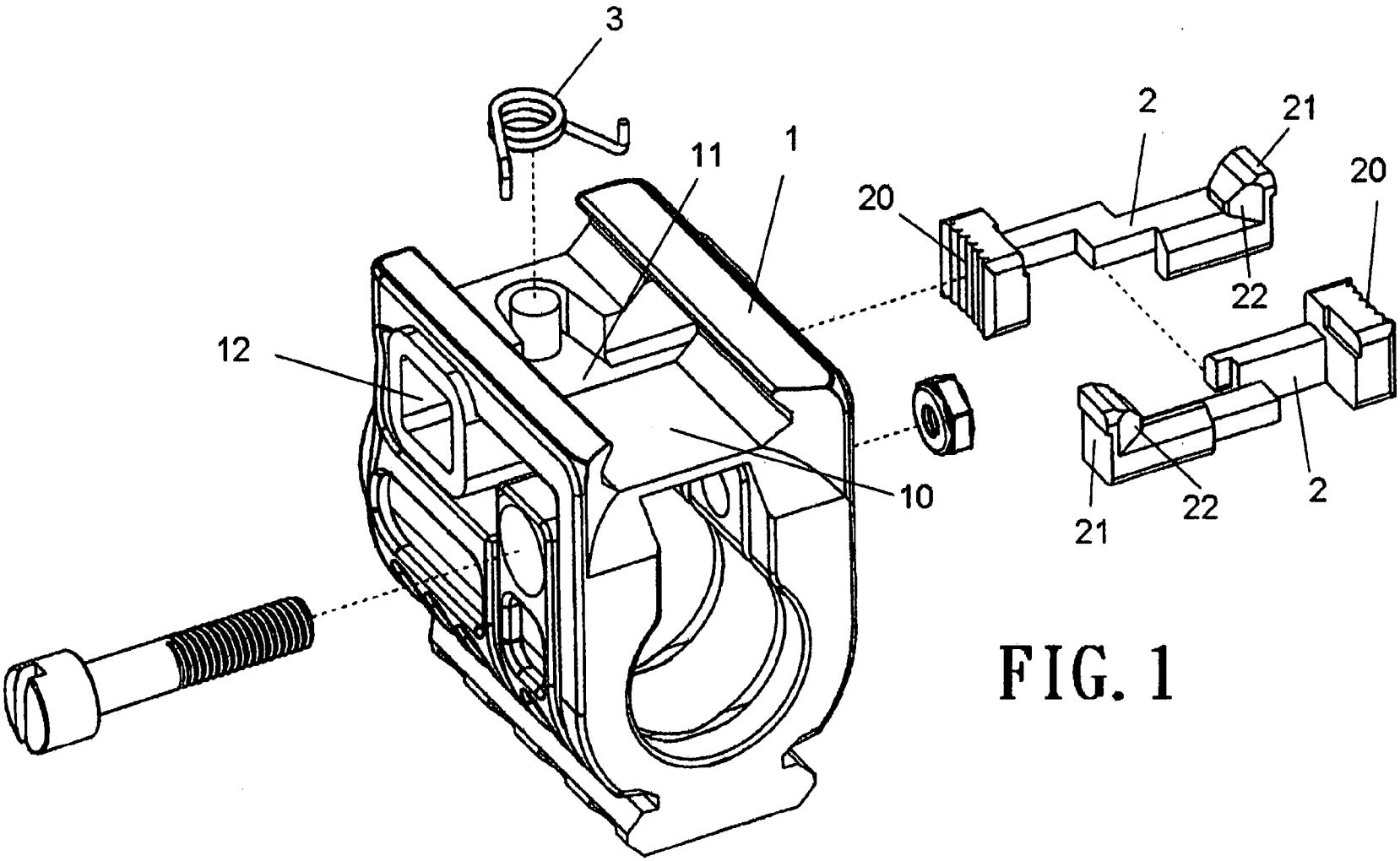
FIG. 1 is an exploded view of a quickly detachable gun attachment holder according to the present invention.

Referring to FIG. 1, a quickly detachable gun attachment holder in accordance with the present invention is shown comprised of a device holder 1, two locking members 2, and a torsional spring 3.

Figure 2:
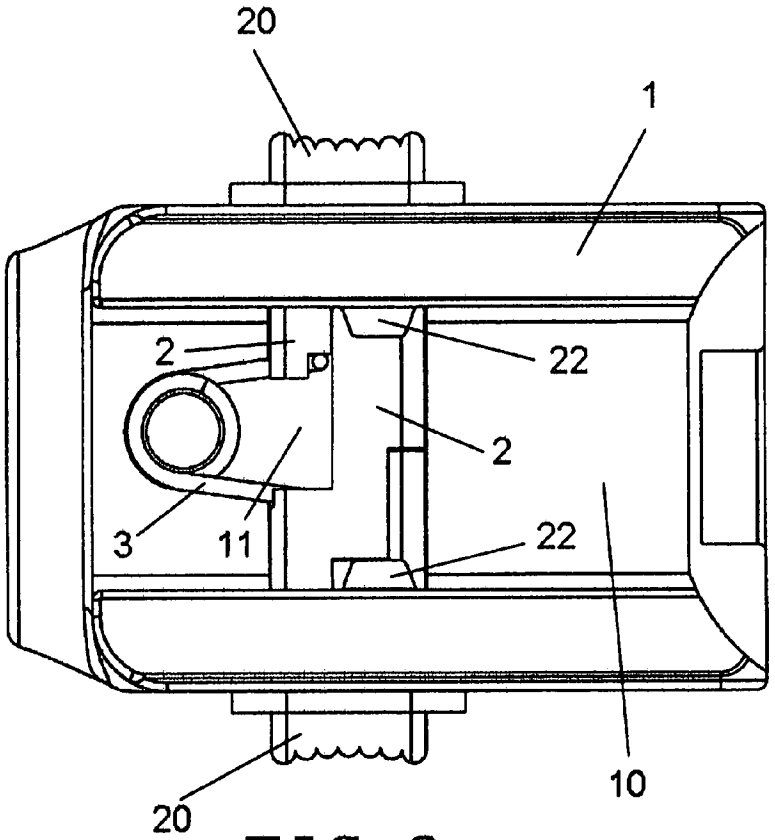
FIG. 2 is a top view of the quickly detachable gun attachment holder according to the present invention.
Figure 3:
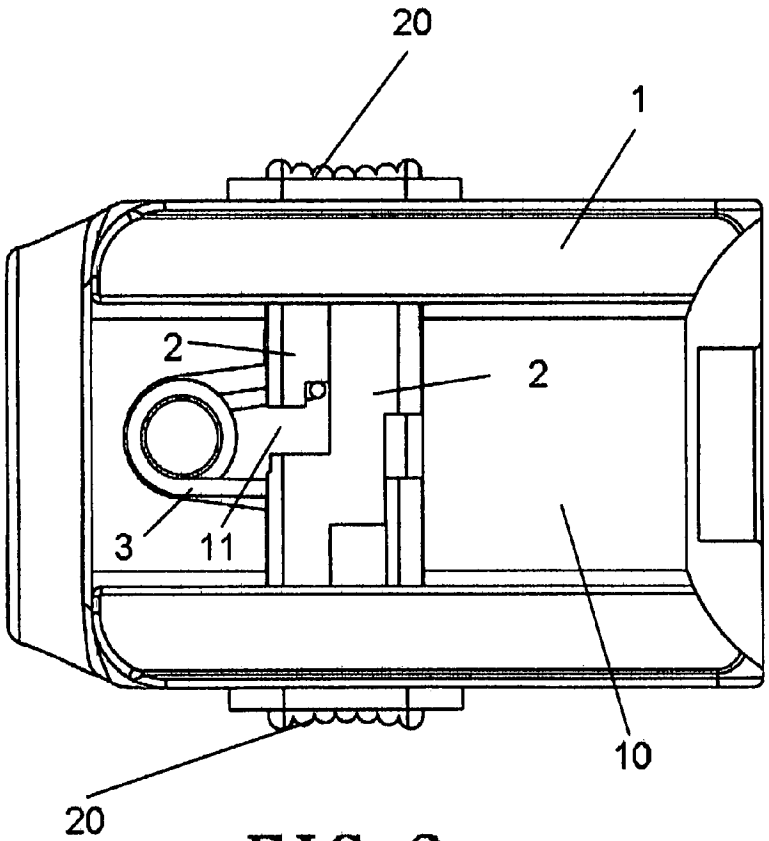
FIG. 3 is similar to FIG. 2 but showing the locking members pressed.
Figure 4:
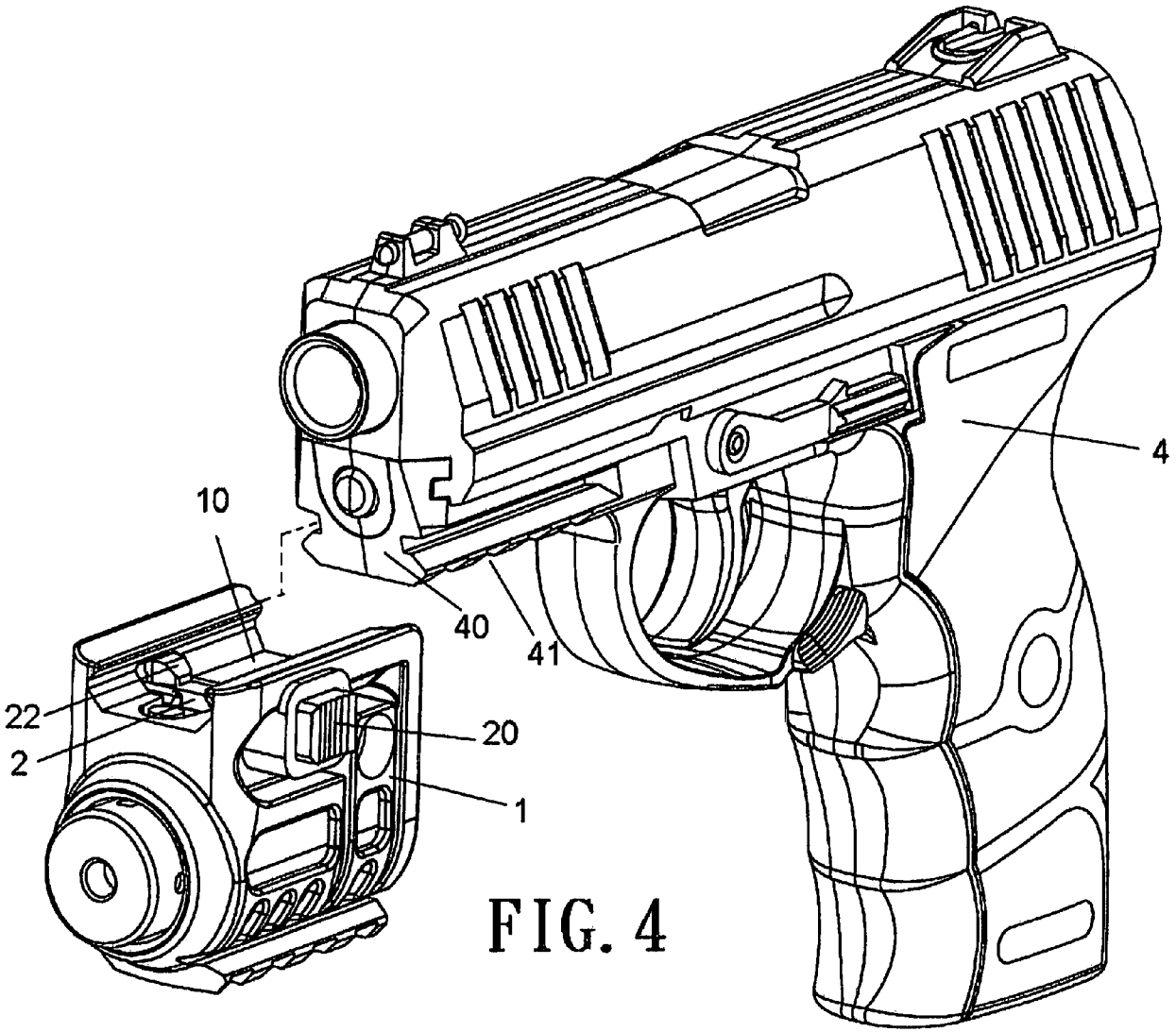
FIG. 4 is an exploded view showing the relationship between the quickly detachable gun attachment holder and the gun according to the present invention.
Figure 5:
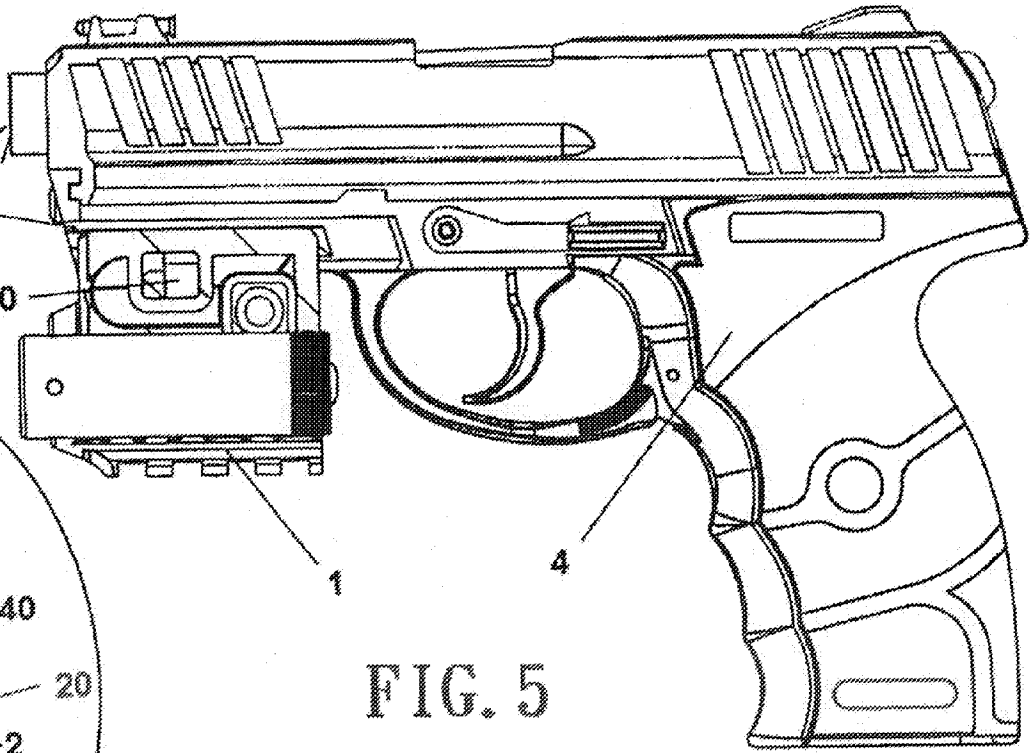
FIGS. 5 and 5A illustrate the quickly detachable gun attachment holder fastened to the gun according to the present invention.
Figure 5A:
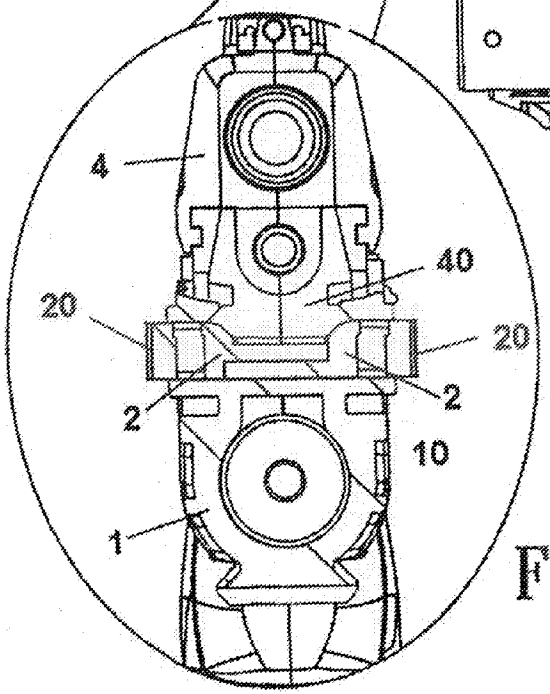

Referring to FIG. 2 and FIG. 1 again, the device holder 1 is adapted to hold an illuminator, infrared pointer, or laser pointer, having a coupling groove 10 longitudinally disposed at the top side, two through holes 12 aligned at two opposite lateral sides of the coupling groove 10, and a transverse sliding groove 11 extending cross the coupling groove 10 in communication between the two through holes 12. The locking members 2 are narrow elongated members reversely arranged in parallel, each having a knob 20 at one end, a stop block 21 at the other end, and an engagement block 22 protruded from the inner side of the stop block 21. The torsional spring 3 is set in between the two locking members 2, having two opposite ends respectively stopped against the two locking members 2. The stop block 21 can be a conical block or beveled block.

Referring to FIGS. 3-5A and FIGS. 1 and 2 again, during installation, the two locking members 2 are reversely arranged in parallel and inserted into the through holes 12 of the device holder 1, and then the torsional spring 3 is mounted in the transverse sliding groove 11 between the two locking members 2 to force the two locking members 2 in two reversed directions. At this time, as shown in FIG. 2, the knob 20 of one locking member 2 is stopped at the outer side of the stop block 21 of the other locking member 2, and the torsional spring 3 imparts an outward force to each locking member 2 to hold each locking member 2 in such a position that the knob 20 is suspending outside the device holder 1 and the stop block 21 is suspending in the coupling groove 10. When in use, the knobs 20 are squeezed with the fingers against the spring force of the torsional spring 3 to move the stop blocks 21 and the respective engagement blocks 22 out of the coupling groove 10 (see FIG. 3), and then the coupling groove 10 is attached to the coupling flange 40 at the bottom side of the barrel of the gun 4. When release the fingers from the knobs 20, the torsional spring 3 immediately returns to its former shape to force the two locking members 2 outwards, and therefore the engagement blocks 22 are respectively formed into engagement with the respective retaining grooves 41 at two sides of the coupling flange 40 (see FIGS. 5 and 5A).

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A gun attachment holder comprising:

a device holder adapted to hold a gun attachment, said device holder having a coupling groove longitudinally disposed at a top side thereof, two through holes aligned at two opposite lateral sides of said coupling groove, and a transverse sliding groove extending cross said coupling groove in communication between said two through holes;

two locking members slidably and reversely arranged in parallel in the through holes and coupling groove of said device holder and adapted to secure said device holder to a gun, said locking member each having a knob at a first end thereof, a stop block at a second end thereof, and an engagement block protruded from an inner side of the stop block, the knob of one of said two locking members being stopped at an outer side of the stop block of the other of said two locking members; and a torsional spring set in between said two locking members, said torsional spring having two opposite ends respectively stopped against said two locking members, wherein the two through holes constrain the locking members to only move laterally in a direction perpendicular to a length of the coupling groove, wherein one locking member of the two locking members is formed as a single piece and the other locking member is formed as two pieces.

2. The gun attachment holder as claimed in claim 1, wherein said stop block is a conical block.

3. The gun attachment holder as claimed in claim 1, wherein said stop block is a beveled block.

4. The gun attachment holder as claimed in claim 1, wherein the engagement blocks of each locking member selectively extend into the coupling groove based on inward pressure being applied to the knobs.

* * * * *